US006157701A

United States Patent [19]

Hirose et al.

[11] Patent Number: 6,157,701

[45] Date of Patent: Dec. 5, 2000

[54] X-RAY GENERATING APPARATUS AND X-RAY MICROSCOPE

[75] Inventors: Hideo Hirose, Saitama; Tamio Hara; Kozo Ando, both of Tokyo; Yoshinobu Aoyagi, Saitama, all of Japan

[73] Assignees: Shimadzu Corporation, Kyoto; The Institute of Physical and Chemical Research, Wako, both of Japan

[21] Appl. No.: 08/876,331

[22] Filed: Jun. 16, 1997

Related U.S. Application Data

[62] Division of application No. 08/587,915, Jan. 17, 1996, Pat. No. 5,680,429.

[30] Foreign Application Priority Data

Jan. 18, 1995 [JP] Japan ..... 7-5465
Jan. 18, 1995 [JP] Japan ..... 7-5477

[51] Int. Cl.[7] ..... G21K 7/00

[52] U.S. Cl. ..... 378/119; 378/120

[58] Field of Search ..... 378/119, 120

[56] References Cited

U.S. PATENT DOCUMENTS 4,704,718 11/1987 Suckewer ..... 372/5
4,771,430 9/1988 Suckewer et al. ..... 372/5
4,866,517 9/1989 Mochizuki et al. ..... 378/119
4,896,341 1/1990 Forsyth et al. ..... 378/119
5,151,928 9/1992 Hirose ..... 378/119
5,680,429 10/1997 Hirose et al. ..... 378/119 X

*Primary Examiner*—David P. Porta
*Attorney, Agent, or Firm*—Nikaido, Marmelstein, Murray & Oram LLP

[57] ABSTRACT

An X-ray generating apparatus in which X-rays are emitted from laser plasma, the X-ray generating apparatus including a strong magnetic field generating device for generating a magnetic field component substantially parallel with the target surface in the vicinity of the laser plasma. The magnetic field component is arranged to generate a magnetic force which acts directly on charged particles in the laser plasma to bend the tracks of the charged particles, causing the charged particles to be confined in a magnetic field formed by the magnetic field component. The magnetic flux of the strong magnetic field is directed to a direction which is different from the direction in which the laser plasma is generated. An X-ray supply object is disposed in the laser plasma generating direction. Charged particles, liable to be directed to the X-ray supply object, are mainly confined in the strong magnetic field.

9 Claims, 9 Drawing Sheets

X-RAY GENERATING APPARATUS AND X-RAY MICROSCOPE

This is a division of application Ser. No. 08/587,915 filed Jan. 17, 1996 now U.S. Pat. No. 5,680,429.

BACKGROUND OF THE INVENTION

The present invention relates to an x-ray generating apparatus using plasma generated by irradiating a laser beam to a target, and to an x-ray microscope comprising an X-ray generating apparatus using such laser plasma.

For example, an x-ray tube or a plasma x-ray source is known as the x-ray source of an x-ray microscope, x-ray laser, an x-ray lithography apparatus, an x-ray photoelectron microscope, an x-ray analyzer or the like.

A plasma x-ray source is arranged to use x-rays generated by interaction between electrons and highly ionized ions in plasma. As a method of generating such high-density plasma, there is known a laser excitation method for example. In this specification, plasma generated by a laser excitation method is called laser plasma. Laser plasma is to be generated by condensing a laser beam on the surface of metal, such as Al, Mo, Au or the like, in the form of pulses each having a width of several ns, the laser beam having been stopped down by a lens or a mirror such that its diameter is for example about 10 $\mu$m~100 $\mu$m.

As an x-ray microscope comprising an x-ray generating apparatus using such laser plasma, there is known a microscope of the type in which x-rays from the x-ray generating apparatus are irradiated to a sample and the transmitted x-rays are measured.

FIG. 21 illustrates a schematic arrangement of a conventional x-ray microscope of the type above-mentioned. This microscope is arranged such that a laser beam 52 is irradiated to a target 51 to generate plasma, that x-rays emitted from the plasma are condensed on a sample 55 in a sample cell 54 by a mirror 53, and that x-rays having passed through the sample 55 are detected by a two-dimensional detector 57 through an enlarging optical system 56.

In an x-ray generating apparatus to be used in such an x-ray microscope or for other purpose, the following arrangement is known as a mechanism for irradiating a laser beam to a target to generate x-rays. That is, flat or disk-like solid metal is for example used as the target, a laser beam is condensed on the surface of the solid metal to generate high-density plasma, and x-rays emitted from free-expanding plasma are guided to the outside of the x-ray generating apparatus. FIG. 22 illustrates, as an example, a schematic arrangement of the x-ray generating apparatus having the arrangement above-mentioned.

In the arrangement in FIG. 22, when a laser beam 7 is focused on and irradiated to the surface of a target 1 of Al, Mo, Au or the like, laser plasma 6 is generated. The laser plasma 6 not only emits scattering particulates composed of neutral particles, charged particles 8 such as ions, electrons and the like, but also x-rays 9. The x-ray generating apparatus is arranged to use, as the x-ray source, such x-rays 9 emitted from the plasma 6. Usually, the x-rays 9 from the plasma 6 are irradiated to an x-ray supply object 11 through an optical element 10 such as a mirror or the like. In an x-ray analyzer for example, the x-ray supply object 11 is used as a sample to be analyzed, x-rays are irradiated thereto and the x-rays on the sample surface are analyzed. In an x-ray microscope, the x-ray supply object 11 is used as a sample to be observed and a detector is disposed therebehind.

In the x-ray generating apparatus having the arrangement above-mentioned, whose pulse shape is controlled by making the laser source the form of multi-pulses or short pulses controls the wavelength of the generated x-rays and the like.

However, such an x-ray generating apparatus of prior art is disadvantageous in that the amount of x-rays to be supplied to the x-ray supply object cannot readily be increased.

More specifically, to improve the x-rays generating efficiency in the apparatus in FIG. 22, it is required to heat or increase the volume of generated plasma by controlling the pulse shape of the laser source. However, since the plasma generally expands freely at a high speed in a vacuum, it is difficult to control the motion of the plasma itself and the plasma momentarily freely expands and spreads. This results in failure to sufficiently improve the x-ray generating efficiency.

In the x-ray generating apparatus in FIG. 22, there is disposed the optical element 10 for introducing the x-rays 9 to the x-ray supply object. In addition to the x-rays 9, scattering particulates composed of charged particles 8 and neutral particles are emitted from the plasma 6, and reach and stick to the surface of the optical element 10, thereby to lower the reflection efficiency of the x-rays 9. This contributes to a reduction in the amount of x-rays to be supplied to the x-ray supply object 11. Thus, the following countermeasure are taken.

To prevent scattering particles from sticking to the optical element 10, there are disposed slits 12 and a scattering particulate preventing means 13 in the direction in which the scattering particles advance from the plasma 6 toward the optical element 10. In the scattering particulate preventing means 13, there may be for example used a method in which there is used a high-speed mechanical shutter arranged such that using a difference in speed between the x-rays and the scattering particulates, the shutter is closed to intercept the passage of the scattering particulates after the high-speed x-rays 9 have passed therethrough. Also, there may be used a method in which a gas inflow device is disposed to let gas to flow from the outside into the path of scattering particulates, causing the gas to come into collision with the scattering particulates to change the tracks thereof. However, such countermeasures cannot securely prevent the scattering particulates from sticking to the optical element 10.

On the other hand, the following apparatus is conventionally known as an x-ray generating apparatus improved in x-ray generating efficiency as compared with the x-ray generating apparatus in FIG. 22. That is, the apparatus is arranged such that an x-ray transmitting film is disposed at one side of the target such that there is formed, between the target and the x-ray transmitting film, a space in which plasma is to be confined. FIG. 23 shows, as an example, a schematic arrangement of such an x-ray generating apparatus.

In the arrangement in FIG. 23, an x-ray transmitting film 72 is so disposed as to form a space 73 adjacent to a tape-like target 71, and plasma generated by irradiating a laser beam 74 to the target 71 is confined in the space 73. In the x-ray generating apparatus in FIG. 23, x-rays are generated in the order as shown in FIG. 24.

When the laser beam 74 is irradiated to the target 71 as shown in FIG. 24(*a*), a target at the irradiation position is evaporated to generate plasma, and x-rays 75 emitted from the plasma pass through the x-ray transmitting film 72 and are then released to the outside, as shown in FIG. 24(*b*). At this time, a hole is formed in the target 71 by the laser beam 74. Further, particulates are emitted together with the x-rays 75 from the plasma thus generated, but these particulates are reduced in speed by the x-ray transmitting film 72. As shown in FIG. 24(*c*), a hole is formed in the x-ray transmitting film 72 by the collision of particulates therewith or by the plasma pressure. Accordingly, the particulates are emitted together with the x-rays 75 through this hole. When the irradiation of a laser beam is finished and the next irradiation is to be conducted, the target 71 and the x-ray transmitting film 72 are moved at their bored portions such that unbored portions of the target 71 and the x-ray transmitting film 72 are located as facing the laser beam irradiation position as shown in FIG. 24(*d*).

In the x-ray generating apparatus having the arrangement above-mentioned, since the x-ray transmitting film 72 is disposed, the plasma is confined in the space 73 to improve the x-ray generating efficiency. However, the scattering particulates are released through the bored portion of the x-ray transmitting film 72 as above-mentioned. This requires a device for eliminating such scattering particulates as done in the apparatus in FIG. 22. It is therefore required to dispose a scattering particulate preventing means such as a high-speed mechanical shutter 76 or the like as shown in FIG. 23.

The scattering particulate preventing means such as the high-speed mechanical shutter 76 or the like is disposed between the target and a sample (x-ray supply object). Due to the presence of such scattering particulate preventing means, the target-sample distance in the order of cm is required. The x-rays emitted from the target can substantially be regarded as those from a point light source. Accordingly, when the target-sample distance is great, the amount of x-rays irradiated to the sample is disadvantageously reduced.

Further, the requirement for such a scattering particulate preventing means causes the following trouble when such an x-ray generating apparatus is applied to an x-ray microscope shown in FIG. 21.

In the x-ray microscope shown in FIG. 21, the condensing mirror 53 between the target 51 and the sample cell 54 is required because the distance between the sample 55 and the x-ray source is long due to the disposition of a scattering particulate preventing means. Due to the provision of the condensing mirror 53, the wavelength characteristics of x-rays reflected by the condensing mirror 53 should accord with the x-ray wavelength characteristics of the enlarging optical system 56 for enlarging and guiding the transmitted x-rays to the detector side. If the x-ray wavelength characteristics of these two optical systems are not identical with each other, it is not possible to condense the x-rays from the x-ray generating apparatus or enlarge the transmitted x-rays. This fails to produce a good x-ray image to disadvantageously lower the quality of x-ray analysis of the sample.

Figure 12:
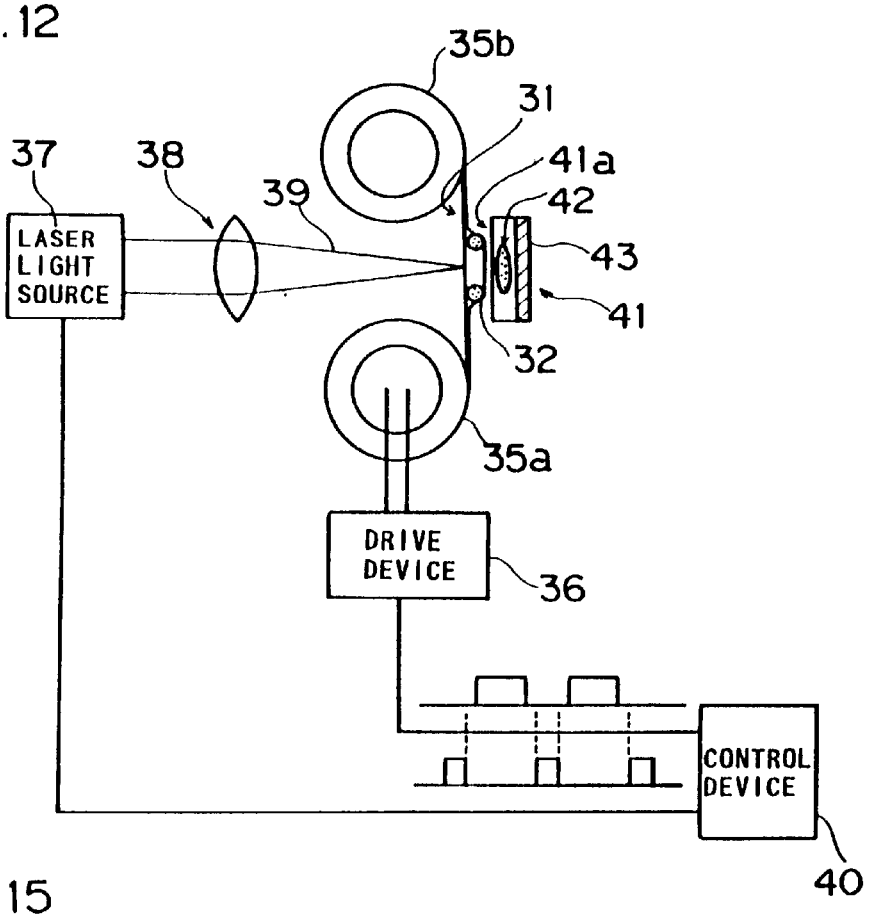
Figure 15:
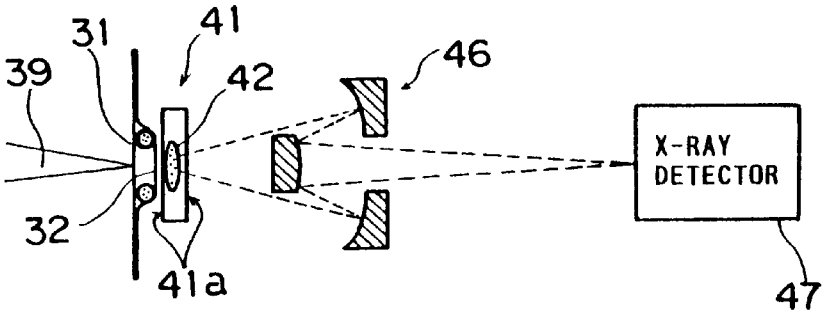
Figure 16:
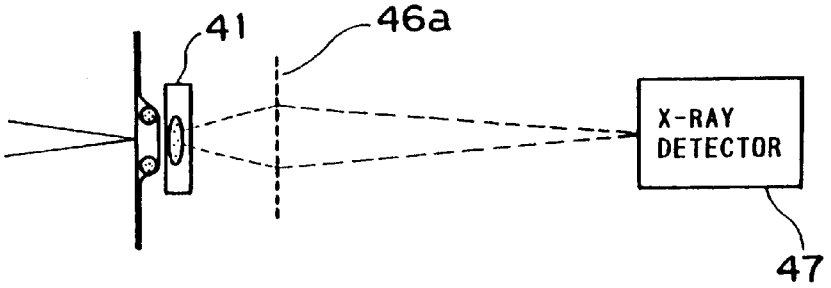
Figure 13:
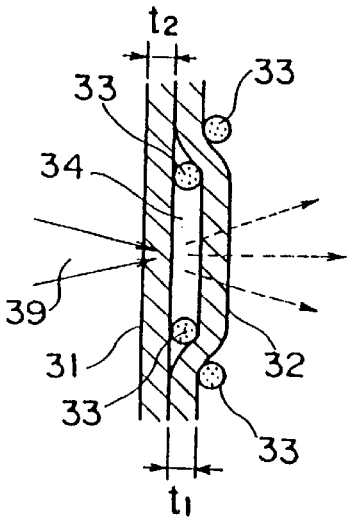
Figure 14A:
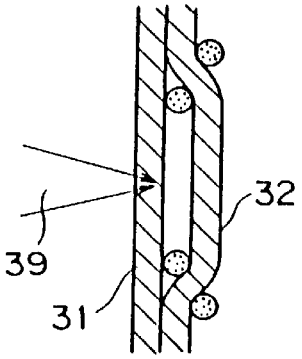
Figure 14C:
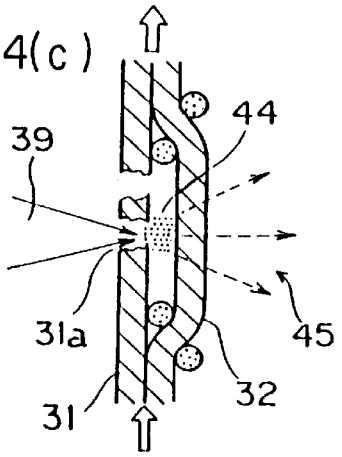
Figure 14B:
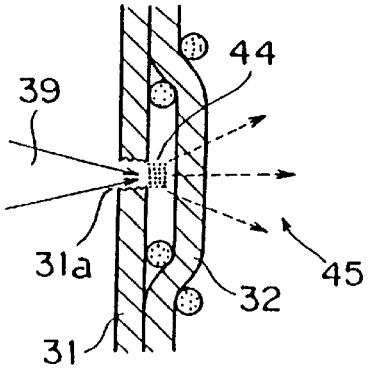
Figure 14C:
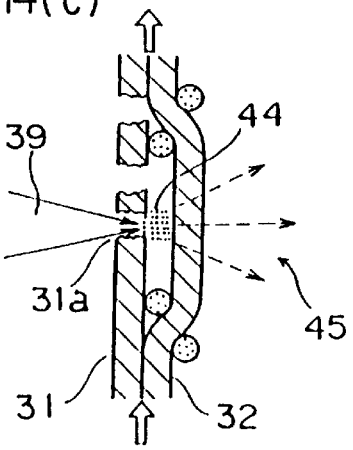
Figure 17:
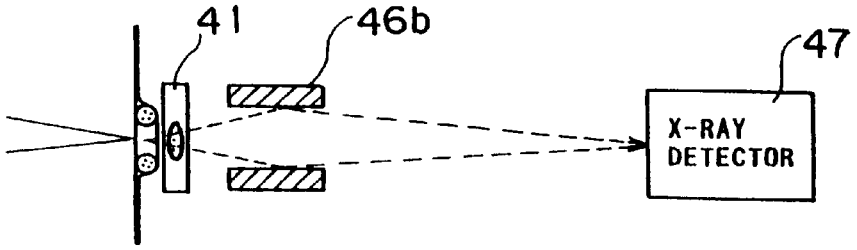
Figure 18:
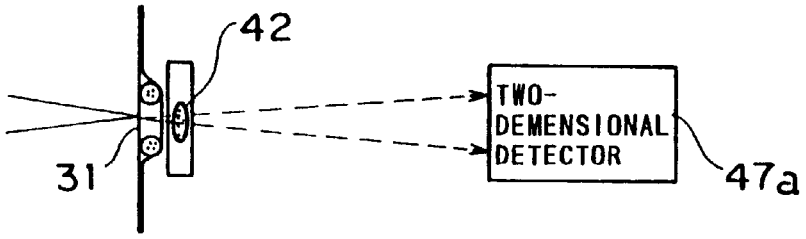
Figure 19:
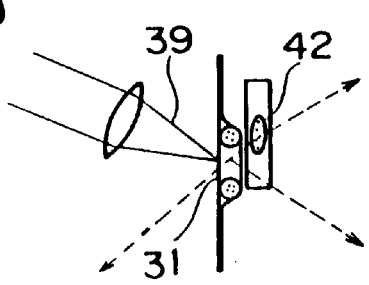
Figure 20:
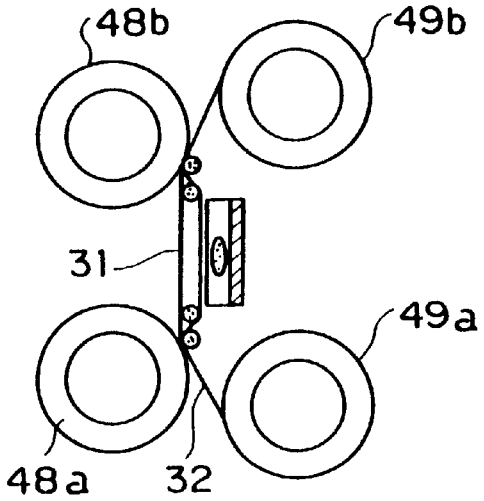
Figure 21:
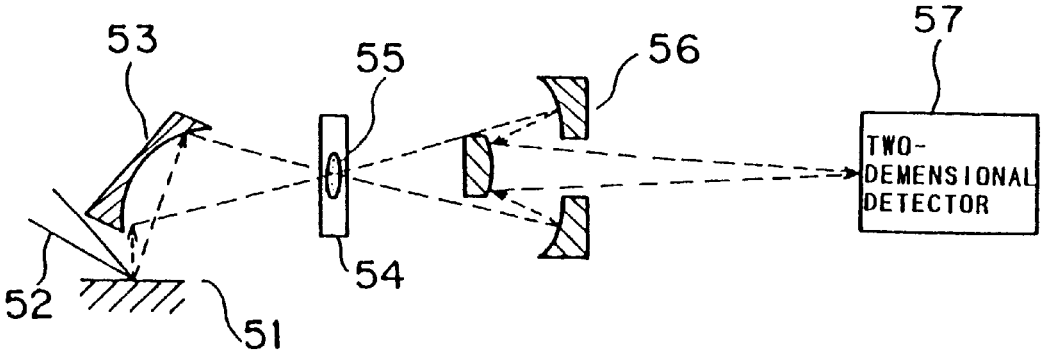
Fig. 21 PRIOR ART
Figure 23:
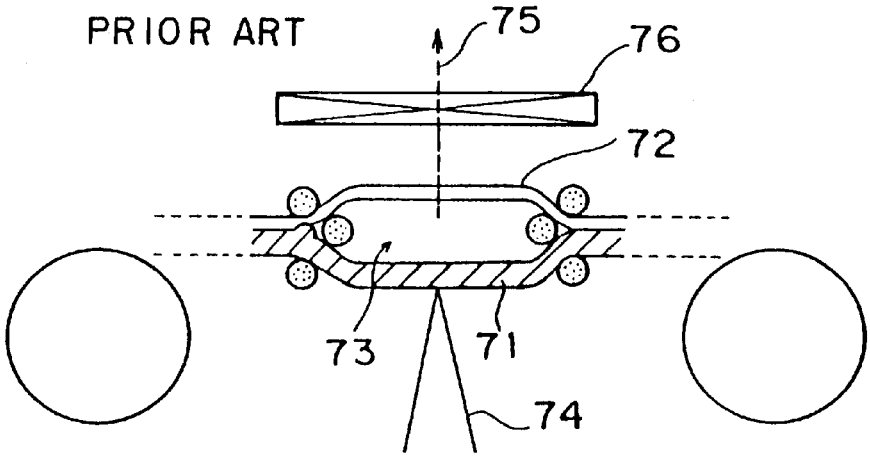
Fig. 23 PRIOR ART
Figure 22:
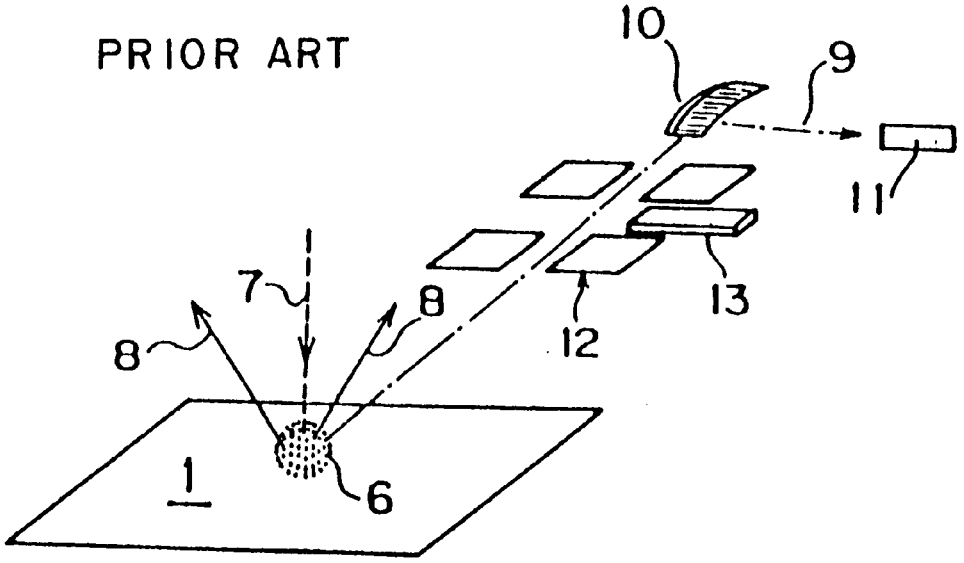
Fig. 22 PRIOR ART
Figure 24:
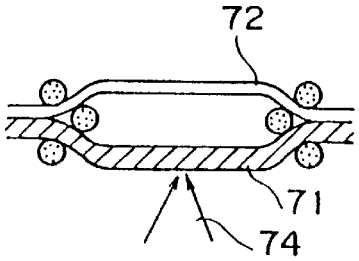
Fig. 24 (a) PRIOR ART
Figure 24:
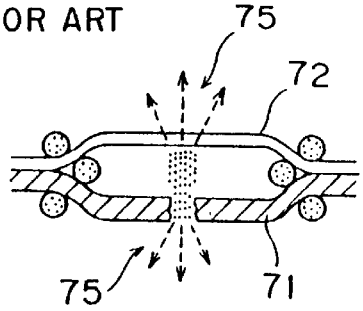
Fig. 24 (b) PRIOR ART
Figure 24:
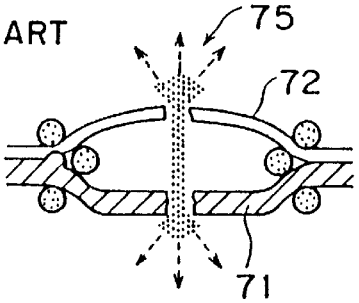
Fig. 24 (c) PRIOR ART
Figure 24:
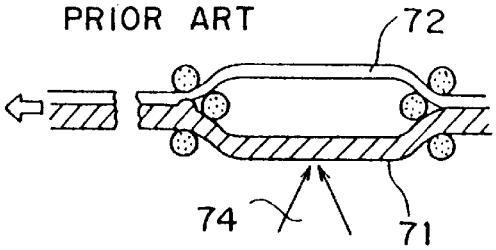
Fig. 24 (d) PRIOR ART

Each of FIGS. 7 to 11 is a schematic view of a specific example of the strong magnetic field generating means in the first invention;

FIG. 12 is a view illustrating the arrangement of an embodiment of each of the second and third inventions;

FIG. 13 is an enlarged view of the target and the x-ray transmitting film in the vicinity of the laser beam irradiation position in the embodiment in FIG. 12;

FIGS. 14(*a*) through 14(*d*)are views illustrating the operation of the arrangement in FIG. 13:

FIG. 15 is a section view illustrating the arrangement of main portions of another embodiment of the third invention;

FIG. 16 is a section view illustrating the arrangement of main portions of a further embodiment of the third invention;

FIG. 17 is a section view illustrating the arrangement of main portions of still another embodiment of the third invention;

FIG. 18 is a view illustrating the arrangement of main portions of a still further embodiment of the third invention;

FIG. 19 is a view illustrating the arrangement of main portions of yet another embodiment of the third invention;

FIG. 20 is a view illustrating the arrangement of main portions of each of the second and third inventions;

FIG. 21 is a view illustrating the arrangement of a conventional x-ray microscope of the type in which x-rays from an x-ray generating apparatus using laser plasma are irradiated to a sample and the transmitted x-rays are observed;

FIG. 22 is a schematic view of an example of the arrangement of a conventional x-ray generating apparatus using laser plasma;

FIG. 23 is a schematic view of an example of the arrangement of another conventional x-ray generating apparatus using laser plasma; and FIGS. 24(*a*) through 24(*d*) are views illustrating the x-ray generating steps in the x-ray generating apparatus in FIG. 23.

OBJECTS AND SUMMARY OF THE INVENTION

It is a first object of the present invention to provide an x-ray generating apparatus using laser plasma capable of preventing scattering particulates from being released or preventing scattering particulates from reaching and sticking to peripheral optical elements and the like.

It is a second object of the present invention to provide an x-ray generating apparatus using laser plasma which is improved in x-ray generating efficiency.

It is a third object of the present invention to provide an x-ray microscope using, as the x-ray source, an x-ray generating apparatus using laser plasma, in which an influence of scattering particulates from the laser plasma is eliminated, in which a sample to be observed can be disposed as close to the x-ray source as possible, thereby to eliminate the disposition of an optical system such as a condensing mirror or the like, and in which the amount of x-rays irradiated to the sample to be observed can be increased, thereby to obtain a bright x-ray image.

To achieve the first and second objects above-mentioned, the first invention provides an x-ray generating apparatus for generating x-rays by laser plasma formed by condensing and irradiating a laser beam on and to a target in a vacuum, and this x-ray generating apparatus is characterized by comprising a strong magnetic field generating means arranged such that a strong magnetic field formed by the strong magnetic field generating means, acts on the laser plasma to bend the tracks of charged particles therein, causing the charged particles to be confined in the magnetic field.

A more specific arrangement of the first invention provides an x-ray generating apparatus in which x-rays emitted from laser plasma generated by condensing and irradiating a laser beam on and to a target in a vacuum, are taken out from at least one side out of the laser beam irradiation side of the target and the side thereof opposite to the laser beam irradiation side, and this x-ray generating apparatus is characterized in that there is disposed, in the vicinity of the laser plasma, a magnetic field generating means for generating a magnetic field component substantially parallel or vertical with respect to the target surface in the vicinity of the laser plasma, this magnetic field component being arranged to generate a magnetic force which acts directly on charged particles in the laser plasma to bend the tracks of the charged particles, causing the same to be confined in a magnetic field formed by the magnetic field component. Further, the magnetic field component formed by the strong magnetic field generating means may contain a magnetic field component inclined at a predetermined angle with respect to the target surface.

According to the first invention, a strong magnetic field formed by the strong magnetic field generating means is arranged to apply a magnetic force to charged particles to change the tracks thereof, causing the charged particles to be confined in the magnetic field. As the means for generating the strong magnetic field, a permanent magnet or an electromagnet may be used. In the strong magnetic field generating means, the direction of the magnetic flux can be adjusted according to the manner in which the strong magnetic field generating means is disposed with respect to the laser plasma or target.

According to the first invention, the laser plasma is generated in a direction at right angles to the target surface and in a predetermined generation pattern with the direction above-mentioned serving as an axis.

In the x-ray generating apparatus of the first invention, when the magnetic flux direction of the strong magnetic field generating means is different from the plasma generating direction, it is possible to enhance the effect of confining, in the magnetic field, charged particles having a speed component deviated from the magnetic flux direction. This improves the x-ray generating efficiency.

In the x-ray generating apparatus of the first invention, when the magnetic flux direction of the strong magnetic field generating means is the same as the plasma generating direction, it is possible to enhance the effect of confining, in the magnetic field, charged particles having a speed component deviated from the plasma generating direction. This improves the x-ray generating efficiency.

In the x-ray generating apparatus of the first invention, the strong magnetic field generating means is disposed in the vicinity of the laser plasma such that a magnetic force acts on charged particles in the strong magnetic field generated by the strong magnetic field generating means, thereby to change the direction in which the charged particles are emitted from the magnetic field. This reduces the amount of charged particles which scatter in a direction toward an x-ray supply object.

According to a specific arrangement for reducing the amount of charged particles scattering in a direction toward the x-ray supply object, the magnetic flux direction of the strong magnetic field generating means is different from the plasma generating direction, and the x-ray supply object is disposed in the plasma generating direction. According to this arrangement, charged particles emitted in the plasma generating direction are taken in the strong magnetic field to reduce the amount of charged particles scattering toward the x-ray supply object.

According to another specific arrangement for reducing the amount of charged particles scattering toward the x-ray supply object, the plasma is generated in the magnetic flux direction of the strong magnetic field generating means and the x-ray supply object is disposed in a direction shifted from the plasma generating direction. According to this arrangement, charged particles emitted in other directions than the plasma generating direction, are taken in the strong magnetic field to reduce the amount of charged particles scattering toward the x-ray supply object.

In the x-ray generating apparatus of the first invention, the target may be disposed at the center of the magnetic field formed by the strong magnetic field generating means. In this case, a uniform and strong magnetic field can be applied to the laser plasma. Such a placement of the target at the center of the magnetic field, may be achieved by disposing the target at the center of the gap between oppositely disposed magnets.

According to the arrangement of the first invention, the strong magnetic field formed by the strong magnetic field generating means bends the tracks of the charged particles emitted from the laser plasma. Bending the tracks causes the charged particles to stay in the laser plasma in a longer period of time, thereby to improve the x-ray generating efficiency. Further, the direction of the tracks of the charged particles which have got out of the strong magnetic field, is shifted from the direction toward the x-ray supply object. This prevents the charged particles from being directed toward the x-ray supply object, thereby to prevent a reduction in x-ray supply amount due to the sticking of charged particles to the optical element or the like.

Figure 1:
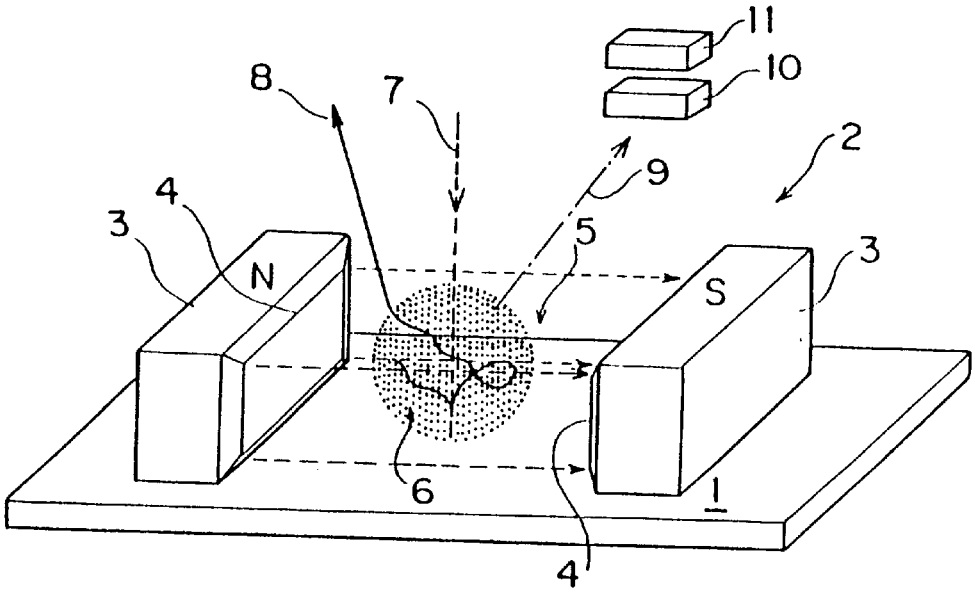
FIG. 1 is a conceptual view of an example of the arrangement of main portions of a first invention.

FIG. 1 is a conceptual view illustrating an example of the arrangement of main portions of the first invention. The following description will discuss the operation of the first invention with reference to FIG. 1. In FIG. 1, when a laser light 7 is condensed on and irradiated to the surface of a target 1 of Al, Mo, Au or the like, plasma 6 is generated by laser excitation. The plasma 6 emits not only scattering particulates including neutral particles and charged particles 8 such as ions, electrons and the like, but also x-rays 9. The x-rays 9 from the plasma 6 are directed toward an x-ray supply object 11 through an optical element 10 such as a mirror or the like.

Figure 2A:
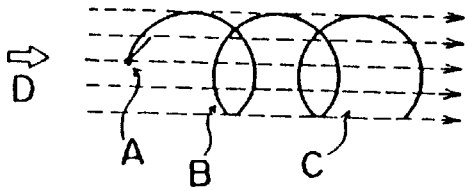
FIG. 2 is a view illustrating the track of a charged particle in a strong magnetic field.
Figure 2B:
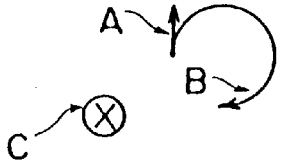
Figure 3:
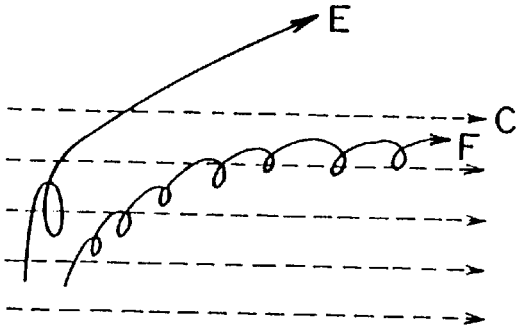
FIG. 3 is an enlarged view illustrating the tracks of charged particles in a strong magnetic field.

The tracks of the charged particles 8 in the plasma are bent by a strong magnetic field 5 formed by a strong magnetic field generating means 2 as shown in FIGS. 2 and 3. The strong magnetic field generating means 2 may be formed, for example, by disposing magnets 3 in the vicinity of or in close contact with the target 1 such that the plasma 6 is formed between the opposite magnetic poles of the respective magnets 3 disposed as facing each other. By disposing pole pieces 4 at the magnets 3, the magnetic field can be increased in intensity.

FIG. 2 is a view illustrating the track of a charged particle in a strong magnetic field. In FIG. 2(*a*), a solid line B shows, in a strong magnetic field C having a directional property shown by arrows in a broken line, the track of a charged particle having an initial speed in a direction shown by an arrow A. FIG. 2(*b*) shows the track of the charged particle when viewed in a direction shown by an arrow D in FIG. 2(*a*). When a charged particle does not come into collision with another charged particle in the strong magnetic field C, the charged particle behaves as follows. That is, while maintaining a speed component in the direction of the strong magnetic field C, the charged particle receives a magnetic force in a direction at right angles to the strong magnetic field C and is moved in the direction of the strong magnetic field C while presenting a spiral motion as shown by the arrow B.

FIG. 3 is an enlarged view illustrating the tracks of charged particles in a strong magnetic field. In FIG. 3, solid lines E and F show the tracks of charged particles as accelerated in the strong magnetic field C. It is now supposed that the charged particles do not come into collision with each other. When the speed of a charged particle is fast as compared with the influence exerted to the track of the charged particle by the strong magnetic field C, the charged particle is moved in a straight line after passed through the strong magnetic field C while presenting a spiral motion, as shown by the solid line E. When the speed of the charged particle is slow, the charged particle is taken in the strong magnetic field C while presenting a spiral motion, as shown by its track shown by the solid line F.

When a strong magnetic field is applied to a zone such as plasma or the like where charged particles are present, each charged particle describes a track along the strong magnetic field while presenting a circular or spiral motion due to the strong magnetic field. The length of the track of a charged particle bent by the strong magnetic field, is longer than that of the track in the same zone when the strong magnetic field is not present. More specifically, when a charged particle is placed in a strong magnetic field, this can make longer the time during which the charged particle stays in the same zone.

Figure 4:
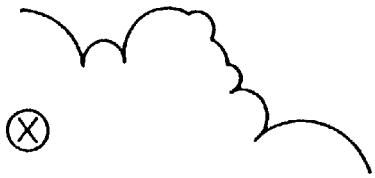
FIG. 4 is a view schematically illustrating a charged particle in spiral motion which comes into collision with another charged particle in a strong magnetic field.

Accordingly, when a strong magnetic field is formed in a zone where plasma is generated as done in the first invention, the time during which charged particles stay in the plasma, is made longer to increase the chances of x-ray generation by the charged particles. This improves the x-ray generating efficiency. FIG. 4 is a view schematically illustrating a charged particle in spiral motion which comes into collision with another charged particle in a strong magnetic field. As compared with a charged particle which is not present in a strong magnetic field, a charged particle present in a strong magnetic field is increased in chance of collision with another charged particle, thus increasing chances of x-ray generation.

Charged particles are emitted from plasma in a variety of directions. As apparent from FIG. 3, however, the tracks of the charged particles generally undergo a change while the charged particles are moved in the direction of the strong magnetic field C while presenting a spiral motion in the strong magnetic field C. Also, the distribution in scattering direction of the charged particles after having passed through the strong magnetic field, undergoes a change according to the direction of the strong magnetic field. Accordingly, in a distribution in scattering direction of the charged particles after having got out of the strong magnetic field, the direction in which scattering frequency is great, can be shifted from the direction toward the x-ray supply object. Such an arrangement can prevent the charged particles from reaching and sticking to the x-ray supply object or the optical system. It is noted that the x-rays are not influenced by the strong magnetic field but advance toward the x-ray supply object or the optical system while maintaining their tracks.

Thus, according to the first invention, it is possible not only to improve the x-ray generation efficiency because of a longer period of time during which the charged particles stay in the plasma, but also to increase the amount of x-rays supplied to the x-ray supply object because of the effect of restraining the scattering particulates from scattering toward the x-ray supply object by controlling the distribution in scattering direction of the charged particles.

To achieve the objects above-mentioned, the second invention provides an x-ray generating apparatus for generating x-rays by irradiating a laser beam to a target, and this x-ray generating apparatus is characterized by comprising an x-ray transmitting film disposed at at least one side of the target with a predetermined gap provided therebetween, the x-ray transmitting film having a thickness such that the film is not broken due to an action in the x-ray generating process, x-rays being taken out through the x-ray transmitting film.

The third invention provides an x-ray microscope using the x-ray generating apparatus of the second invention, and this x-ray microscope is characterized by comprising: an x-ray generating apparatus which has an x-ray transmitting film disposed at at least one side of the x-ray generating target with a predetermined distance provided therebetween, this x-ray transmitting film being arranged not to be broken due to an action in the x-ray generating process, and in which x-rays generated by irradiating a laser beam to the target, are taken out through the x-ray transmitting film, a sample to be observed being disposed in the vicinity of the x-ray transmitting film; and a detecting means for detecting an x-ray image formed by the x-rays passed through the sample to be observed.

In each of the second and third inventions, factors acting on the x-ray transmitting film in the x-ray generating process, include the plasma pressure generated in the x-ray generating process, the transmission of a laser beam to be irradiated for x-ray generation, scattering light which scatters in the plasma, and the like. The x-ray transmitting film used in each of the x-ray generating apparatus and x-ray microscope of the second and third inventions, is a member which is good in x-ray transmittance and which has a function of preventing the passage of scattering particulates. The thickness of the x-ray transmitting film is set such that the film is not broken due to the plasma pressure and the energy of scattering particulates resulting from the generation of high-density plasma by the irradiation of a laser beam.

In a preferred embodiment of each of the second and third inventions, the thickness of the x-ray transmitting film exceeds at least 1 $\mu$m, and is in the range of 2 to 3 $\mu$m for example. Thus, the x-ray transmitting film can not only transmit x-rays generated by the high-density plasma, but also intercept scattering particulates generated at the same time.

Examples of the material of the x-ray transmitting film to be used in each of the second and third inventions, include Al, Be, C, Sn, Ti, V, Mo, polyimide, vinyl and the like.

When the x-ray transmitting film used in each of the second and third inventions is made of Al, Be or polyimide, there can be obtained an x-ray generating apparatus or an x-ray microscope having an x-ray transmitting film excellent in transmittance of x-rays having a wavelength not greater than 20 Å.

When the x-ray transmitting film is made of Sn, Ti or V, there can be obtained an x-ray microscope or an x-ray generating apparatus having an x-ray transmitting film excellent in transmittance of x-rays having a wavelength of 20 Å to 50 Å

When the x-ray transmitting film is made of C, Sn or Mo, there can be obtained an x-ray microscope or an x-ray generating apparatus having an x-ray transmitting film excellent in transmittance of x-rays having a wavelength of 45 Å to 100 Å

In a preferred embodiment of each of the second and third inventions, each of the target and the x-ray transmitting film is made in the form of a tape and provision is made such that the target and the x-ray transmitting film are movable with respect to the laser beam irradiation position and the sample to be observed. This enables the target and the x-ray transmitting film to be substantially replaced for each irradiation of a laser beam.

According to the third invention, as the detector for detecting an x-ray image, there may be used a two-dimensional detector such as CCD, MCP, an x-ray film or the like.

According to the third invention, the x-ray transmitting film, the sample to be observed and the resist may be disposed in the vicinity of one another. Thus, there may be provided a contact-type x-ray microscope in which the resist and the sample to be observed come in close contact with each other.

In the arrangement of each of the second and third inventions, plasma is generated by irradiating a laser beam to the target. From the high-density plasma thus generated, x-rays and scattering particulates are emitted. Of these, the x-rays are taken through the x-ray transmitting film and released toward the x-ray supply object (sample to be observed). On the other hand, the scattering particulates are intercepted by the x-ray transmitting film and cannot scatter toward the sample to be observed.

Accordingly, there is no need for interposing a scattering particulate preventing means between the x-ray supply object (sample to be observed) and the x-ray source. This enables the x-ray supply object and the x-ray source to be disposed as close to each other as possible. Further, without an optical system such as a condensing mirror or the like interposed between the x-ray supply object and the x-ray source, the amount of x-rays supplied to the x-ray supply object can be increased such that a bright x-ray image can be obtained in the x-ray microscope.

When plasma is generated by the irradiation of a laser beam to the target, a pressure generated by the free-swelling of the plasma is applied to the x-ray transmitting film and scattering particulates come into collision therewith. However, when the thickness of the x-ray transmitting film exceeds at least 1 $\mu$m, and is in the range from 2 to 3 $\mu$m for example, such a thickness is sufficient to resist the plasma pressure and the collision energy of scattering particulates such that the x-ray transmitting film is not broken.

Further, by the irradiation of a laser beam, the target is bored and scattering particulates stick to the x-ray transmitting film. As the target and the x-ray transmitting film, a tape-like target and a tape-like film may be used as mentioned earlier and moved by a suitable distance for each irradiation of a laser beam. Accordingly, a nonbored portion of the target may be supplied to the laser beam irradiation position, and that portion of the x-ray transmitting film to which no scattering particulates are sticking, may be positioned at the laser beam irradiation position. It is therefore possible to always supply a large quantity of x-rays to the x-ray supply object.

DETAILED DESCRIPTION OF PREFERRED EMBODIMENTS

Figure 5:
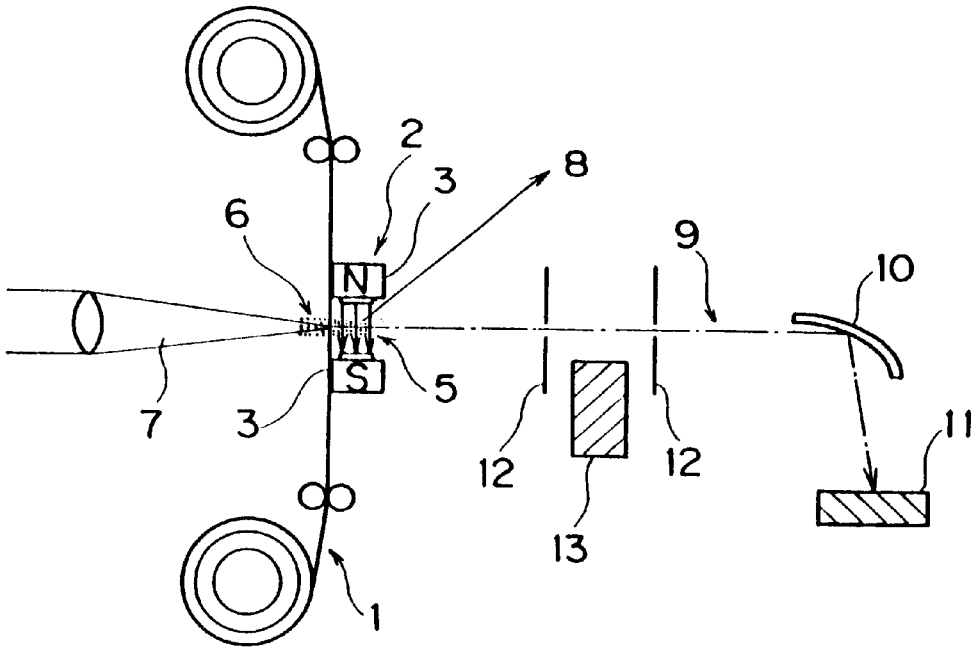
FIG. 5 is a view illustrating the arrangement of an embodiment of the first invention.

FIG. 5 is a view illustrating the arrangement of an embodiment of the first invention. In this arrangement, the x-ray taking direction is opposite to the side at which a laser beam is irradiated to a target.

In FIG. 5, the target is formed by a tape target 1 of a tape-like thin film, and a laser beam 7 is irradiated, as condensed in a point or line shape, to the tape target 1 at one side thereof. The irradiation of the laser beam 7 produces high-density plasma 6 at both sides of the tape target 1. Charged particles 8 and x-rays 9 are released from the plasma 6 to both sides of the tape target 1. In this embodiment, however, the x-rays emitted to the side opposite to the laser beam 7 are utilized.

In this embodiment, a pair of magnets 3 are disposed as sandwiching the plasma 6 generated at the side opposite to the laser beam irradiation side, thereby to form a strong magnetic field generating means 2. A strong magnetic field 5 formed by the strong magnetic field generating means 2, gets across the plasma 6. The x-rays 9 emitted from the plasma 6 are guided to an optical element 10 through slits 12 and a scattering particulate preventing means 13. Then, the x-rays 9 are irradiated to an x-ray supply object 11 such as a sample or the like through the optical element 10. As the scattering particulate preventing means 13, there may be used a high-speed mechanical shutter arranged such that, after the x-rays 9 have passed through the shutter, the shutter is operated to intercept the course of low-speed scattering particulates. Also, there may be used a gas flowing device for causing gas to flow from the outside into the course of the scattering particulates such that gas molecules come into collision with scattering particulates, thereby to change the tracks of the scattering particulates.

The strong magnetic field 5 formed by the strong magnetic field generating means 2 is arranged (i) to lengthen the time during which the charged particles 8 remain in the plasma 6, (ii) to increase the opportunity of the charged particles 8 coming in contact with one another, thereby to increase the x-ray generating efficiency, and (iii) to reduce a distribution, in the direction toward the optical element 10, of the charged particles 8 after having got out from the strong magnetic field 5. Since the x-rays 9 are not influenced by the strong magnetic field 5, the x-rays 9 advance toward the optical element 10 and are then irradiated to the sample 11.

Even though the strong magnetic field generating means 2 restrains the charged particles 8 from scattering toward the optical element 10, there is still present a small amount of charged particles 8 which scatter toward the optical element 10. The slits 12 and the scattering particulate preventing means 13 prevent such charged particles 8 from scattering toward the optical element 10. This improves the charged particles preventing effect. Further, the slits 12 and the scattering particulate preventing means 13 also prevent the neutral particles scattering with no influence exerted thereto by the strong magnetic field, from sticking to the optical element 10.

The following description will discuss specific examples of the strong magnetic field generating means 2 in the embodiment above-mentioned with reference to the schematic views in FIGS. 7 to 11.

Figure 7:
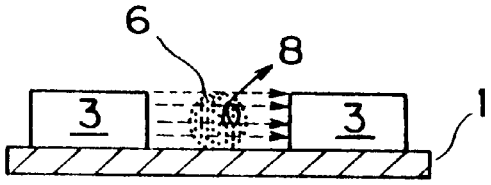

FIG. 7 shows an example in which the strong magnetic field 5 is formed only in the vicinity of the plasma generating zone. There are disposed a pair of magnets 3 each having a height substantially equal to the size of the plasma 6 generated by the irradiation of the laser beam 7, such that the plasma 6 is held by and between the magnets 3. As each of the magnets 3, there may be for example used a magnet of which magnetic pole distance is several mm and of which intensity is about 10000 G(1T).

In FIG. 7, the direction of the strong magnetic field 5 formed by the magnets 3 is substantially parallel with the target 1. The charged particles 8 in the plasma 6 receive a force at right angles to the magnetic field direction by the magnetic force of the strong magnetic field 5 and present a spiral motion (shown by an arrow in a solid line in FIG. 7). This not only lengthens the time during which the charged particles 8 stay in the plasma, but also changes the distribution in scattering direction of the charged particles 8 emitted from the strong magnetic field 5. Here, it is noted that the plasma is generated in a direction at right angles to the target surface and that the plasma is generated in a predetermined generating pattern with the direction above-mentioned serving as an axis.

The time during which the charged particles 8 stay in the plasma 6, and the distribution in scattering direction of the charged particles 8 emitted from the strong magnetic field 5, depend on the conditions such as the energy of a laser beam to be irradiated, the size and distribution of the strong magnetic field 5 and the like. It is therefore desired that these relationships are previously obtained by experiments or the like and that the conditions above-mentioned are suitably set according to the disposition direction of the optical element 10 or the required amount of x-rays.

Figure 8:
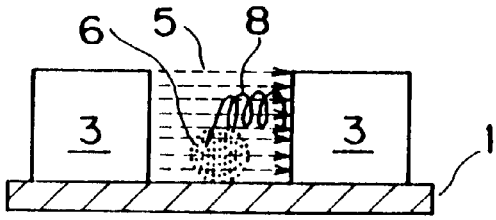

FIG. 8 is an example in which the strong magnetic field 5 is formed not only in the plasma 6 generating zone but also in a zone which extends by a certain distance in the x-ray taking direction from the plasma generating zone. There are disposed magnets 3 each having a height exceeding the size of the plasma 6 generated by the laser beam 7, such that the plasma 6 is held by and between the magnets 3.

In FIG. 8, the strong magnetic field 5 formed by the magnets 3 is substantially parallel with the target 1. Initially, the charged particles 8 in the plasma 6 receive a force at right angles to the magnetic field direction by the magnetic force of the strong magnetic field 5 and present a spiral motion. Then, when the charged particles 8 are emitted from the plasma 6 and reach the zone in which only the strong magnetic field 5 exists, there is no acceleration for the charged particles 8 due to free expanding of the plasma 6. Accordingly, the speed held by the charged particles 8 is only the initial speed. Accordingly, in this zone, the charged particles 8 present a spiral motion along the direction of the strong magnetic field 5 and is confined therein as far as the charged particles come into collision with one another (shown by an arrow in a solid line in FIG. 8).The size of the zone where only the magnetic field exists, can be set according to the volume of the plasma to be generated and the intensity of the strong magnetic field.

Accordingly, the arrangement in FIG. 8 produces the effect that the rate of charged particles confined in the strong magnetic field 5 is increased while the rate of charged particles to be emitted toward the optical element 10, is decreased.

Figure 9:
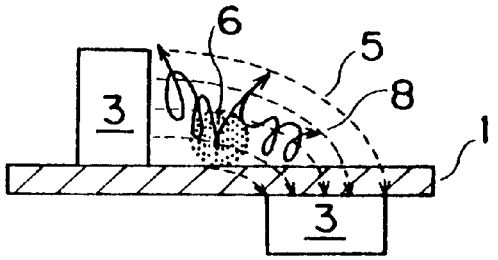

FIG. 9 shows an example in which the direction of the magnetic flux of the strong magnetic field is inclined with respect to the surface of the target 1. To form such a strong magnetic field 5, one of a pair of magnets 3 is disposed at one side of the target 1 such that the magnetic poles are directed in a direction at right angles to the surface of the target 1, and the other magnet is disposed at the other side of the target 1 such that the magnetic poles are directed in a direction parallel with the surface of the target 1.

In FIG. 9, the direction of the strong magnetic field 5 formed by the magnets 3 is inclined at a predetermined angle with respect to the surface of the target 1 or the plasma 6 generating direction. Because of the inclination of the magnetic field, the charged particles 8 emitted from the plasma 6 generally advance as presenting a spiral motion in the direction connecting the magnetic poles of the respective magnets 3 (shown by an arrow in a solid line in FIG. 9).

According to the arrangement in FIG. 9, the charged particles emitted from the strong magnetic field 5 can be distributed as biased in the direction above-mentioned.

Figure 10:
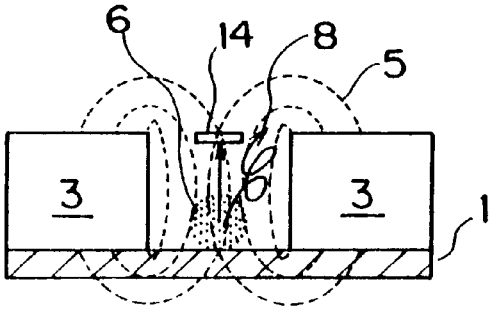

FIG. 10 shows an example in which the direction of the strong magnetic field is at right angles to the surface of the target 1 or the same as the plasma generating direction. To form such a strong magnetic field 5, a pair of magnets 3 are disposed such that the plasma 6 generated by the irradiation of a laser beam is held by and between the magnets 3 and that the magnetic poles are directed in a direction parallel with the surface of the target 1.

In FIG. 10, the direction of the strong magnetic field 5 formed by the magnets 3 is substantially vertical with respect to the surface of the target 1. Out of the charged particles 8 in the plasma 6, those having a speed component in a direction identical with the direction of the strong magnetic field 5, advance as they are with no influence exerted thereto by the strong magnetic field 5. Charged particles having a speed component in a direction deviated from the direction of the strong magnetic field 5, are influenced by the strong magnetic field 5. These charged particles receive a force in a direction at right angles to the magnetic field direction by the magnetic force of the strong magnetic field 5, and present a spiral motion while advancing along the magnetic flux direction of the strong magnetic field 5. Then, these charged particles are confined in the strong magnetic field 5 as far as they do not come into collision with one another (shown by an arrow in a solid line in FIG. 10).

In this example, charged particles having a speed component in a direction identical with the direction of the strong magnetic field 5, advance with no influence exerted thereto by the strong magnetic field 5. To prevent such charged particles from being emitted to the outside, a screening member 14 is disposed on an extension line in the magnetic flux direction passing through the plasma 6.

Figure 11:
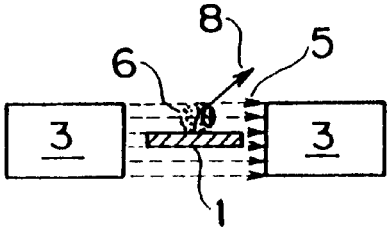

FIG. 11 shows an example in which the target 1 is disposed at the center of the strong magnetic field generated by the strong magnetic field generating means. In this arrangement, a uniform and strong magnetic field can be applied to laser plasma.

In the example in FIG. 11, a pair of magnets 3 are disposed with a distance provided therebetween such that the magnetic poles respectively having opposite polarities face each other, and the target 1 is disposed at the center of the strong magnetic field 5 formed between the magnets 3. The intensity of the magnetic field in this arrangement is the greatest at the center where the target 1 is disposed. That is, the magnetic field having the greatest intensity is applied to laser plasma generated in the vicinity of the target 1. It is therefore possible to apply a uniform and strong magnetic field to the laser plasma. Thus, the confinement of laser plasma and the correction of the tracks of charged particles can more effectively be conducted.

In each of the examples in FIGS. 8 to 11, there may be used, as each magnet 3, a magnet of which magnetic pole distance is several mm and of which intensity is 10000 G(1T), likewise in the example in FIG. 7. It is desired to previously obtain, by experiments or the like, the relationships between (i) each of the time during which charged particles stay in the plasma and the directional distribution of the charged particles scattering from the strong magnetic field, and (ii) the conditions such as the energy of the laser beam to be irradiated, the size and distribution of the strong magnetic field 5 or the like, such that the desired x-ray irradiation amount is obtained based on the relationships thus obtained. It is also desired to set such conditions as to minimize the amount of charged particles scattering toward the optical element.

Figure 6:
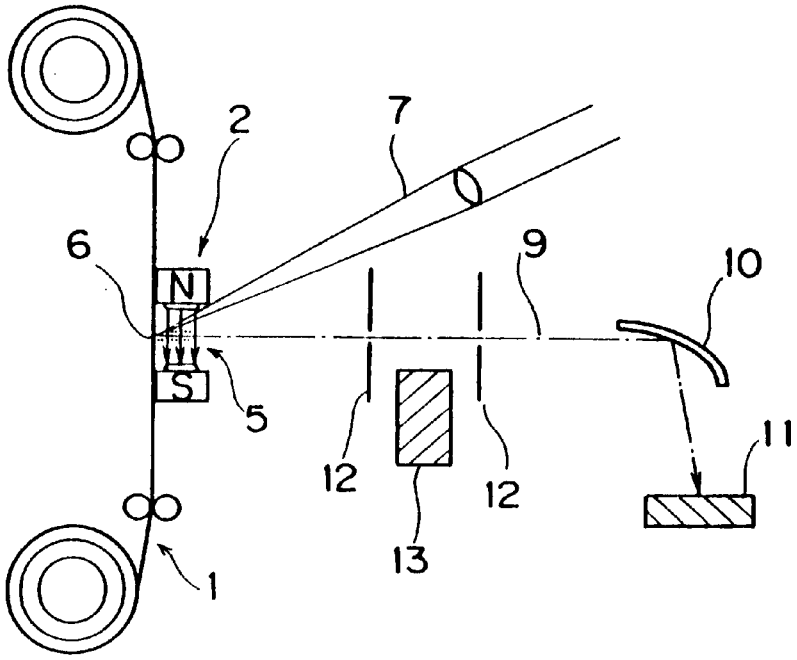
FIG. 6 is a view illustrating the arrangement of another embodiment of the first invention.

The following description will discuss another embodiment of the first invention. FIG. 6 shows the arrangement thereof. In this embodiment, the x-ray taking direction is identical with the direction in which a laser beam 7 is irradiated to a target 1. This embodiment is the same in arrangement as the embodiment in FIG. 5, except that x-rays are to be taken out from a plasma portion at the laser beam irradiation side of the target 1, out of plasma generated by irradiating the laser beam 7.

As a strong magnetic field generating means 2 in this embodiment, there may be used any of the means shown in FIGS. 7 to 11. Thus, there may be produced effects equivalent to those produced by the embodiment mentioned earlier.

As the magnets 3 used in the strong magnetic field generating means 2 in each of the embodiments above-mentioned, electromagnets may also be used instead of permanent magnets. When electromagnets are used, the intensity of the strong magnetic field 5 or the distribution in magnetic flux of the strong magnetic field 5 can be changed to control the time during which charged particles stay in the plasma, or to change the distribution in scattering direction of the charged particles.

In each of the embodiments above-mentioned, a tape target is used as the target. It is a matter of course, however, that a plane target or a cylindrical target can also be used.

The following description will discuss embodiments of the second and third inventions.

FIG. 12 is a view illustrating the arrangement of an embodiment of an x-ray microscope according to the third invention using an x-ray generating apparatus of an embodiment of the second invention. That is, FIG. 12 shows an embodiment common in the second and third inventions. FIG. 13 is an enlarged section view of a target 31 and an x-ray transmitting film 32 in the vicinity of a zone where a laser beam 39 is irradiated in FIG. 12.

As shown in FIG. 13, each of the target 31 and the x-ray transmitting film 32 is made in the form of a tape, and the target 31 and the film 32 are placed one upon another. At the position where the laser beam 39 is irradiated, a gap of about 1 mm for example is formed between the target 31 and the x-ray transmitting film 32 by holding members 33, thus forming a space 34.

Examples of the material of the target 31 include Al, Au, Mo, Ta, Ti and Kapton(trademark). The tape-like target 31 may have a width of about 5 mm and a thickness t2 of about 1 to about 10 $\mu$m.

The x-ray transmitting film 32 may be made of Al, Be, C, Sn, Ti, V, Mo, polyimide or vinyl. The material is selected dependent on the wavelength of x-rays to be transmitted. For example, the x-ray transmitting film 32 is made of Al, Be or polyimide when there are transmitted x-rays having a wavelength of about 20 Å or less; C, Sn, Ti, V or polyimide when there are transmitted x-rays having a wavelength of about 20 Å to 50 Å; and Sn or Mo when there are transmitted x-rays having a wavelength of 45 Å to 100 Å. The x-ray transmitting film 32 has a width of about 5 mm for example and a sufficient thickness ti such that the x-ray transmitting film 32 is not broken as resisting the plasma pressure and the energy of scattering particulates. Thus, the film thickness t1 exceeds at least 1 $\mu$m and is suitably in the range of about 2 to about 3 $\mu$m for example. To prevent the film 32 from being broken, the film thickness t1 is suitably changed according to the plasma and scattering particulate forming conditions such as the intensity of the laser beam irradiated to the target 31, the irradiation time, the volume of the space where plasma is to be generated, and the like.

The tape-like target 31 and the tape-like x-ray transmitting film 32 are wound at both ends thereof on common winding members 35*a*, 35*b* and intermittently moved by a drive device 36 as shown in FIG. 12. The drive device 36 may mainly be formed by an intermittently operable actuator such as a step motor or the like. In association with the irradiation of the laser beam 39, the drive device 36 is controlled by a control signal from a control device 40 to move a predetermined amount of each of the target 31 and the x-ray transmitting film 32 for each irradiation of the laser beam 39.

The laser beam 39 to be irradiated to the target 1 is generated by a laser light source 37 to be driven and controlled by the control device 40 and an optical system 38 for condensing the output light of the laser light source 37. The laser beam 39 is irradiated to the target 31 at the side opposite to the side where the x-ray transmitting film 32 is disposed. The control device 40 controls the irradiation timing of the laser beam 39 and the moving timing of the target 31 and the x-ray transmitting film 32 as follows. After completion of the emission of x-rays by the irradiation of the laser beam 39, the control device 40 causes the target 31 and the x-ray transmitting film 32 to be moved, and then causes the laser beam 39 to be irradiated after completion of the movement of the target 31 and the x-ray transmitting film 32. The laser light source 37 is driven by a drive pulse of about 3 to about 7 nsec for example.

A sample cell 41 is disposed in the vicinity of the side of the x-ray transmitting film 32 opposite to the side where the target 31 is disposed. The sample cell 41 includes a sample 42, and is provided in the side thereof facing the x-ray transmitting film 32 with an x-ray window 41*a*. The sample cell 41 also has a resist 43 at the side opposite to the x-ray window 41*a*. The resist 43 is placed in contact with the sample cell 41. The x-ray window 41*a* and the x-ray transmitting film 32 can be disposed in close proximity to each other with a distance of 0.1 mm for example provided therebetween. As above, by making the resist 43 and the sample cell 41 come closely into contact, a contact x-ray microscope may be formed.

The following description will discuss the x-ray generating process in the embodiment above-mentioned with reference to FIG. 14.

As shown in FIG. 14(*a*), the space 34 is formed between the target 31 and the x-ray transmitting film 32 by the holding members 33, and the laser beam 39 is irradiated to the target 31. As shown in FIG. 14(*b*), the target 31 is then evaporated to generate high-temperature and high-density plasma 44, from which high-luminance x-rays 45 are radially generated. The plasma 44 generated by the irradiation of the laser beam 39 is confined in a period of time in the order of nsec in the space 34 defined by the target 31 and the x-ray transmitting film 32. This lengthens the time during which the interaction between the laser beam 39 and the plasma is conducted, thus efficiently generating x-rays. At this time, a bore 31*a* having a diameter of about 10 $\mu$m~100 $\mu$m is formed in the target 31 by the laser beam 39 as shown in FIG. 14(*b*). The x-rays 45 thus generated pass through the x-ray transmitting film 32 and are emitted not only toward the sample side, but also toward the laser light source side through the bore 31*a*.

On the other hand, particulates generated from the plasma 44 come into collision with the x-ray transmitting film 32 such that their kinetic energies are absorbed and reduced in speed. Thus, the particulates do not pass through the x-ray transmitting film 32 but are caught thereby. As a result, the scattering particulates stick to the x-ray transmitting film 32.

At the step where one irradiation of the laser beam 39 is finished and x-ray generation is also finished, the bore 31*a* is formed in the target 31 and the scattering particulates stick to the x-ray transmitting film 32. This is not an environment suitable for the next irradiation of laser beam for x-ray generation.

At this point of time, the target 31 and the x-ray transmitting film 32 are moved. More specifically, the target 31 is moved such that its portion having no bore 31*a* reaches the laser beam irradiation position, and the x-ray transmitting film 32 is moved such that its portion having no scattering particulates stuck thereto reaches the x-ray transmitting position. At such a state, the laser beam 39 is irradiated as shown in FIG. 14(*c*). Again, the target 31 is bored at 31*a* and scattering particulates stick to the x-ray transmitting film 32. Thereafter, the target 31 and the x-ray transmitting film 32 are similarly moved and the laser beam 39 is then irradiated as shown in FIG. 4(*d*). By repeating the operations above-mentioned, x-ray generation is intermittently repeated.

The amount of movement of the target 31 for each irradiation of the laser beam 39 may be set such that at least the irradiation position of the laser beam 39 does not overlap the bore 31*a*. The amount of movement of the x-ray transmitting film 32 for each irradiation of the laser beam 39, may be set such that at least the x-ray transmitting position does not overlap the scattering particulate sticking zone. For example, each of the amounts of movement may be for example about 1 mm. Such an amount of movement may be smaller than the amount of movement of each of the target and the x-ray transmitting film in the x-ray generating apparatus of prior art shown in FIG. 23. More specifically, in the x-ray generating apparatus of prior art in FIG. 23, the x-ray transmitting film is bored as shown in FIG. 24 and such bore must be kept sufficiently away from the plasma. For example, the x-ray transmitting film is required to be moved by 2 to 3 mm for example. In the embodiment above-mentioned, however, the x-ray transmitting film 32 is not bored. Thus, the amount of movement of the x-ray transmitting film 32 can accordingly be reduced.

The x-rays thus generated are irradiated, through the x-ray window 41*a*, to the sample 42 in the sample cell 41 disposed in the vicinity of the x-ray transmitting film 32. The x-rays having passed through the sample 42 reaches the resist 43 at the back side of the sample cell 41 such that an x-ray image of the sample is formed.

In this embodiment, the scattering particulates emitted from the plasma are intercepted by the x-ray transmitting film 32. This involves no likelihood that the scattering particulates exert adverse effects to the sample or the like. It is therefore not required to dispose a scattering particulate preventing means, a condensing optical system or the like between the x-ray source and the sample as done in apparatus of prior art. Thus, the x-ray transmitting film 32 and the sample cell 41 can be disposed in close proximity to each other. This enables the x-rays emitted through the x-ray transmitting film 32 to reach the sample 42 before diffused and damped. Thus, the amount of x-rays irradiated to the sample 42 is remarkably increased as compared with a prior art apparatus. Further, the arrangement requiring no optical system such as a condensing mirror or the like between the x-ray source and the sample or the like, is advantageous also in view of elimination of adjustment or the like of the wavelength characteristics of the optical system.

The following description will discuss another embodiment of the third invention. FIG. 15 shows in section the arrangement of main portions of this embodiment. In this embodiment, a sample cell 41 having two parallel x-ray windows 41*a* and a sample 42 housed therebetween, is disponed in the vicinity of an x-ray transmitting film 32. Thus, an x-ray image of the sample 42 in the sample cell 41 is enlarged through an x-ray enlarging optical system 46 and formed on the sensitive surface of an x-ray detector 47. As the x-ray detector 47, CCD, MCP or the like may be used. In this embodiment, a Schwarzschild optical system comprising two concavo-convex mirrors is used as the x-ray enlarging optical system 46.

FIGS. 16 and 17 are section views respectively illustrating the arrangements of main portions of a further embodiment and still another embodiment of the third invention. The embodiment in FIG. 16 employs a zone plate 46*a* as the enlarging optical system interposed between the sample cell 41 and the x-ray detector 47, while the embodiment in FIG. 17 employs a Wolter-type mirror 46*b* as the enlarging optical system interposed between the sample cell 41 and the x-ray detector 47.

FIG. 18 shows the arrangement of main portions of a still further embodiment of the third invention. This embodiment employs the arrangement in which the x-ray image of a sample 42 disposed in the vicinity of a target 31 is enlarged as directly projected on a two dimensional detector 47*a* separated, for example, by dozens of cm or more from the sample 42. This arrangement is made based on the fact that the x-rays can be regarded as generated from a point light source since the x-rays are generated from a fine zone in the form of a spot in the order of 10 $\mu$m.

In each of the embodiments of the second and third inventions, the incident angle of the laser beam 39 upon the target 31 is perpendicular to the surface of the target 31. However, such an incident angle may be optionally set. More specifically, the x-rays generated from plasma formed by the irradiation of the laser beam 39 are radial. Accordingly, even though the laser beam 39 is irradiated to the target 31 at any incident angle, the x-rays can readily be taken out in the desired direction. To obtain a more practical x-ray generating apparatus or x-ray microscope, it is desired to make provision as shown in a schematic layout in FIG. 19 such that the laser beam 39 is irradiated to one side of the target 31 in an oblique direction and that x-rays emitted in an oblique direction from the other side of the target 31 are irradiated to the sample 42. The arrangement in FIG. 19 is advantageous in that the sample 42 is not influenced by the laser beam 39 having passed through the target 31.

FIG. 20 shows the arrangement of main portions of yet another embodiment of each of the second and third inventions. In this embodiment, a target 31 and a x-ray transmitting film 32 are individually wound on winding members 48*a*, 48*b* and winding members 49*a*, 49*b*. According to this arrangement, it is not required to previously prepare the target 31 and the x-ray transmitting film 32 in a double-layer structure. Further, this arrangement is advantageous in that the amounts of movement of the target 31 and the film 32 can individually be set.

We claim:

1. In an x-ray generating apparatus in which x-rays emitted from laser plasma formed by condensing and irradiating a laser beam on and to a target in a vacuum, are taken out from at least one side out of the laser beam irradiation side of the target and the side thereof opposite to said laser beam irradiation side, said x-ray generating apparatus comprising:

a strong magnetic field generating means for generating a magnetic field component substantially vertical with respect to the target surface in the vicinity of said laser plasma, said magnetic field component being arranged to generate a magnetic force which acts directly on charged particles in said laser plasma to bend the tracks of said charged particles, causing said charged particles to be confined in a magnetic field formed by said magnetic field component, the magnetic flux of a strong magnetic field formed by said strong magnetic field generating means, is directed to the direction in which said laser plasma is generated, an x-ray supply object is disposed in a direction different from said laser plasma generating direction, and charged particles liable to be directed to said x-ray supply object are mainly confined in said strong magnetic field, wherein said target is disposed at the center of said strong magnetic field formed by said strong magnetic field generating means.

2. In an x-ray generating apparatus in which x-rays emitted from laser plasma formed by condensing and irradiating a laser beam on and to a target in a vacuum, are taken out from at least one side out of the laser beam irradiation side of the target and the side thereof opposite to said laser beam irradiation side, said x-ray generating apparatus comprising:

a strong magnetic field generating means for generating a magnetic field component substantially parallel with the target surface in the vicinity of said laser plasma, said magnetic field component being arranged to generate a magnetic force which acts directly on charged particles in said laser plasma to bend the tracks of said charged particles, causing said charged particles to be confined in a magnetic field formed by said magnetic field component, wherein the magnetic flux of a strong magnetic field formed by said strong magnetic field generating means, is directed to a direction different from the direction in which said laser plasma is generated, an x-ray supply object is disposed in said laser plasma generating direction, and charged particles liable to be directed to said x-ray supply object are mainly confined in said strong magnetic field.

3. An x-ray generating apparatus according to claim 2, wherein the magnetic flux is directed in specific directions for effective confinement of charged particles.

4. An x-ray generating apparatus according to claim 2, further comprising a scattering particulate preventing means for intercepting low-speed scattering particulates.

5. An x-ray generating apparatus according to claim 4, wherein said scattering particulate preventing means comprises a high-speed mechanical shutter.

6. An x-ray generating apparatus according to claim 2, wherein the magnetic flux is directed in specific directions for effective confinement of charged particles, and wherein said apparatus further comprises a scattering particulate preventing means for intercepting low-speed scattering particulates.

7. An x-ray generating apparatus according to claim 2, wherein said target is disposed at the center of said strong magnetic field formed by said strong magnetic field generating means.

8. In an x-ray generating apparatus in which x-rays emitted from laser plasma formed by condensing and irradiating a laser beam on and to a target in a vacuum, are taken out from at least one side out of the laser beam irradiation side of the target and the side thereof opposite to said laser beam irradiation side, said x-ray generating apparatus comprising:

a strong magnetic field generating means for generating a magnetic field component substantially vertical with respect to the target surface in the vicinity of said laser plasma, said magnetic field component being arranged to generate a magnetic force which acts directly on charged particles in said laser plasma to bend the tracks of said charged particles, causing said charged particles to be confined in a magnetic field formed by said magnetic field component, the magnetic flux of a strong magnetic field formed by said strong magnetic field generating means is inclined with respect to a surface of the target, an x-ray supply object is disposed in a direction different from said laser plasma generating direction, and charged particles liable to be directed to said x-ray supply object are mainly confined in said strong magnetic field.

9. An x-ray generating apparatus for generating x-rays by laser plasma formed by condensing and irradiating a laser beam on and to a target in a vacuum, said x-ray generating apparatus comprising:

a strong magnetic field generating means for applying a magnetic field to charged particles in said laser plasma, said strong magnetic field generating means being arranged to form a strong magnetic field for generating a magnetic force which bends the tracks of said charged particles in said laser plasma, causing said charged particles to be confined in said strong magnetic field, wherein said target is disposed at the center of said strong magnetic field formed by said strong magnetic field generating means.

* * * * *